United States Patent [19]

Guery et al.

[11] 4,009,457

[45] Feb. 22, 1977

[54] ELECTRO-MAGNETIC CONTACTOR

[75] Inventors: Jean-Pierre Guery, Poissy; Guy Lacan, Carrieres-Sous-Bois, both of France

[73] Assignee: La Telemecanique Electrique, France

[22] Filed: June 17, 1975

[21] Appl. No.: 587,588

[30] Foreign Application Priority Data

Sept. 13, 1974 France ..... 74.31011

[52] U.S. Cl. ..... 335/132; 335/197

[51] Int. Cl.[2] ..... H01H 67/02

[58] Field of Search ..... 335/132, 197

[56] References Cited

UNITED STATES PATENTS 3,553,617 1/1971 Turnbull et al. ..... 335/132 X

FOREIGN PATENTS OR APPLICATIONS 1,387,976 12/1964 France ..... 335/132

11,489 5/1964 Japan ..... 335/132

*Primary Examiner*—George Harris

*Attorney, Agent, or Firm*—William Anthony Drucker

[57] ABSTRACT

The present invention relates to a guidance system for the movable element of a contactor.

The shaped sections constituting the walls have channels formed during the extrusion thereof wherein are located pivoting and elastic restoring members which guide the contact unit.

6 Claims, 5 Drawing Figures

Figure 3:
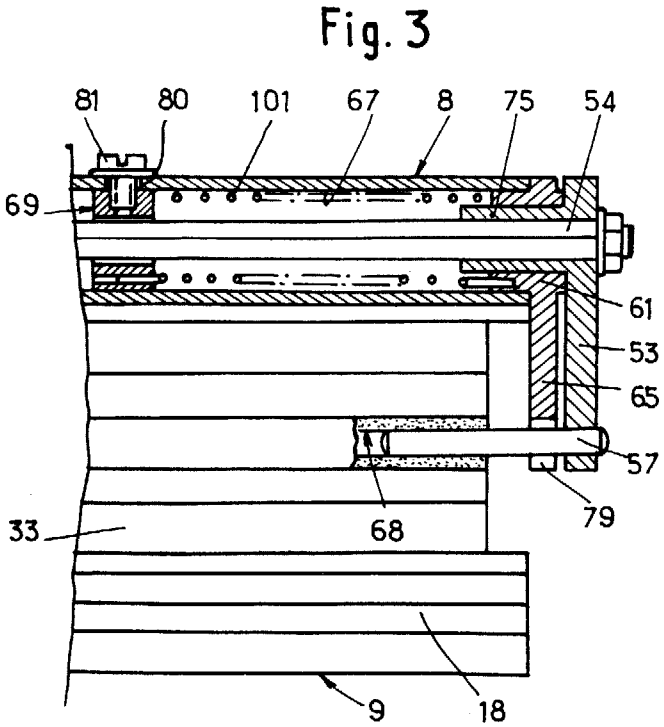

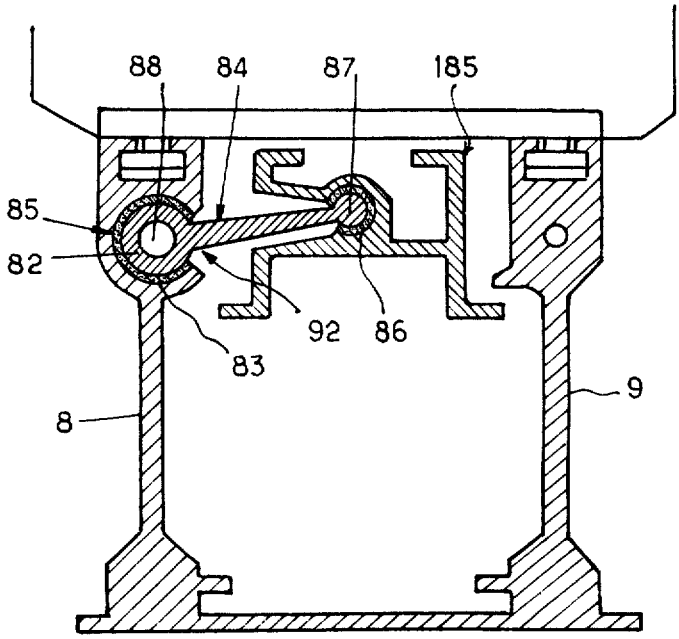
Fig. 4
Fig. 5
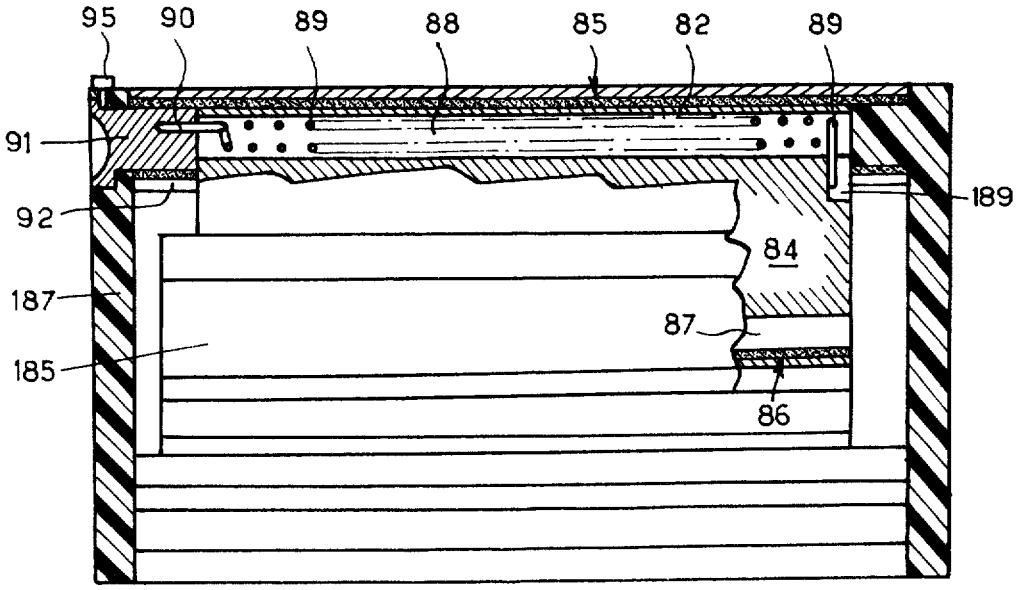

ELECTRO-MAGNETIC CONTACTOR

The present guidance system can be applied to a contactor such as described in French Pat. application No. 7,400,159.

The present invention relates to a electro-magnetic contactor having two generally planar shaped sections constituting two parallel walls, each connected in the lower portion thereof by a base which is fixed to a support and having in the other portion thereof a system of slides able to receive a variable number of detachable contacts whose actuating members sliding in the switching chamber also co-operate with a third coupling section which is placed between the first two sections and whose movement is ensured by an electromagnet, by a guidance system and by elastic restoring means.

Such a contactor is, for example, known from French Pat. application No. 7,400,159 of 3rd Jan. 1974, and which is open to certain improvements with the particular aim of improving the guidance system.

If, in fact, a contactor of the type described hereinbefore is fixed to a vertical wall, one of the shoes ensuring the guidance of the armature is loaded more than the other which may cause local wear. Moreover, the independence of the restoring and guidance members may, if one of them fails, lead to jamming due to the absence of parallelism. Finally, the use of restoring springs of limited length leads to a greater dispersion in the inherent characteristics, whilst the exposure of these springs to the outside atmosphere may cause their corrosion and the guidance members with which they are associated may be disadvantageously affected by abrasive dust deposits.

Therefore, the present invention proposes to supply an electro-magnetic contactor in accordance with the prior art but wherein the special construction of the known apparatus is utilized for fitting a restoring and guidance system for the armature which does not suffer from the disadvantages indicated hereinbefore.

A further object of the invention is to ensure decreased reliability and quality of operation, accompanied by a considerable reduction in construction costs.

Finally, the invention aims at obtaining an elastic restoring system, wherein measures are taken to adapt the rigidity of the elastic members to the power of the motor and to the number of detachable contacts used on the apparatus.

From the variants, it will possible to gather the special measures taken for bringing about a reduction in the number of members to be machined, optionally accompanied by an improvement in the quality of guidance.

According to the invention, these desired results are more particularly achieved through at least one of the walls having a cylindrical longitudinal recess obtained during extrusion wherein oscillate pivoting members of at least one guidance or restoring lever whose elastic member is arranged coaxially to the longitudinal recess whereby the opposite end of the lever is supported on an articulation, whose centering members are formed during the extrusion of the coupling section.

A further result is obtained through using grooved sections whose channels serve to hold and pivot the restoring and guidance members.

The final object of the invention is achieved through the attachment point of the two helical springs working in torsion being displaceable without any significant intervention for adapting the restoring forces to the motive and resistance curves of the electro-magnet or to those of the sets of contacts used.

Figure 1:
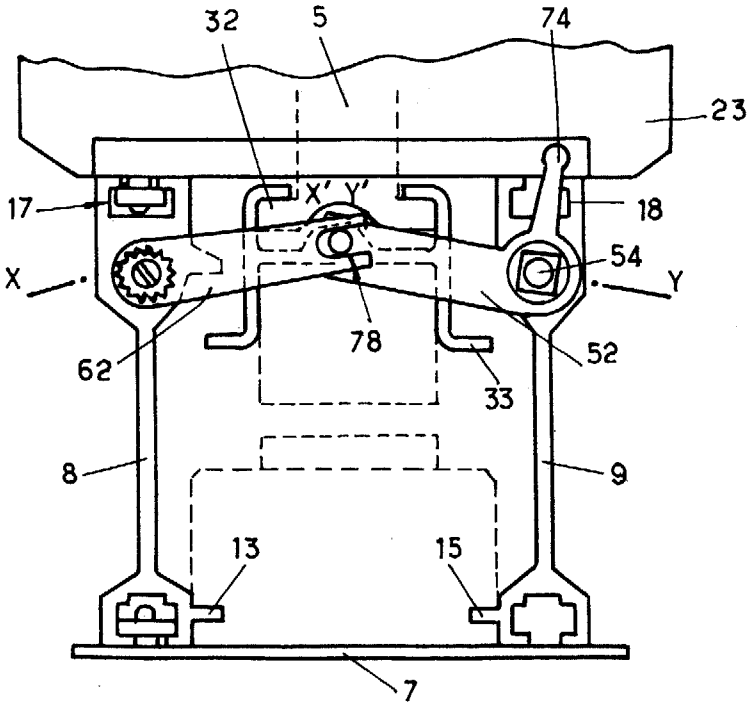

Other interesting features of the invention can be gathered from the following description with reference to the drawings, wherein show:

FIG. 1 a side view of the apparatus in which the lateral flange is not shown.

Figure 2:
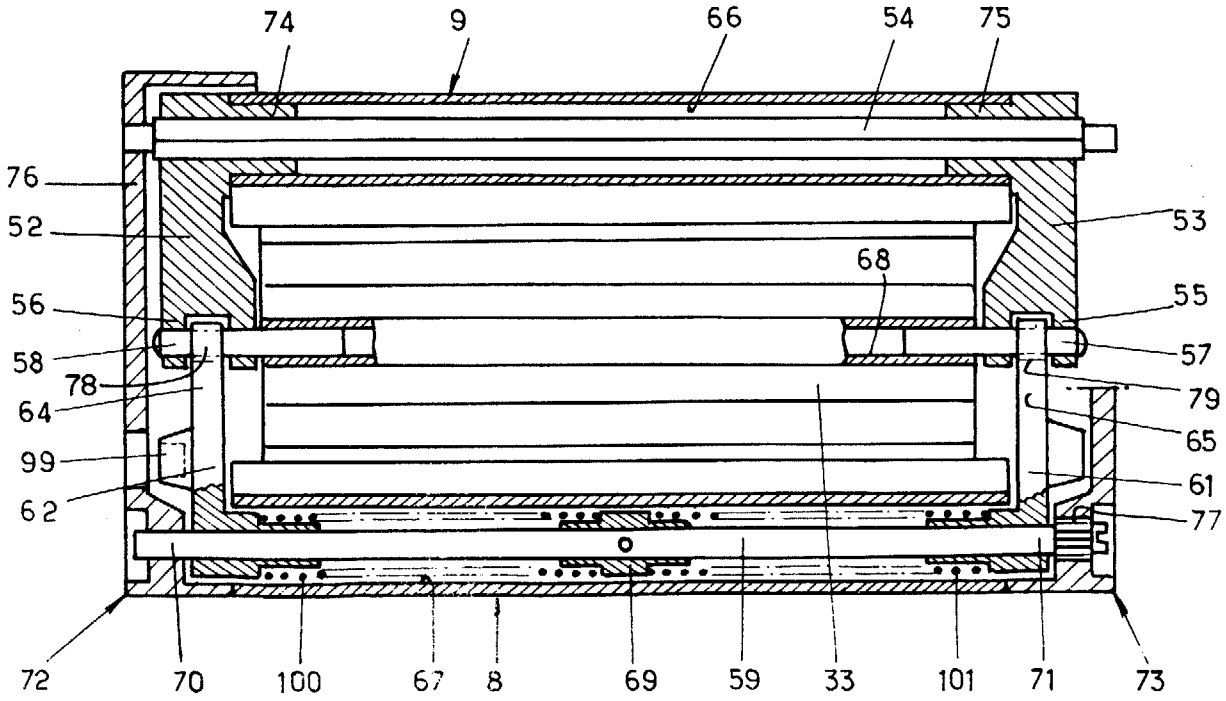

FIG. 2 a plan view of the apparatus with a partial cross-section passing through the XX' and YY' planes.

FIG. 3 a variant wherein the two systems of levers are coaxial.

FIGS. 4 and 5 a second variant wih a single solid lever.

In FIG. 1 the reference numeral 7 represents the base or fixing plate of the apparatus onto its support such as the panel or frame of a cubicle.

This base 7 can be in the form of a single member with two parallel walls 8, 9 and can be obtained by extrusion or on the other hand it can comprise an independent plate which receives the two sections 8, 9 by means of not shown fixing elements. The upper portion of each of the walls has a system of grooved slides 17, 18 permitting the fixing of detachable contact units such as 23 by a movement perpendicular to the plane of FIG. 1. Each contact unit has its own single or double breaking switching members whose actuating member 5 of a contact unit is guided in its upper portion within the unit whilst its lower portion has an external coupling member 32.

During the movement of the contact unit mentioned hereinbefore, this member is coupled with a slide constituting a movable member 33 which is a section obtained by extrusion so as to have projections and connecting walls and which is placed between the two walls 8, 9.

FIG. 1 neither shows the movable armature of the electromagnet which is associated with this slide nor the fixed core of the electro-magnet held with its coil by ribs 13, 15 of the walls.

As the contacts arranged in the contact unit are generally mounted with a certain degree of freedom, it is unnecessary for the movements of this unit to be strictly parallel.

However, it is advantageous for the closing of the different contacts to take place as simultaneously as possible in such a way that the movement of the coupling slide 33 ensures that the latter is kept perpendicular to the plane of FIG. 1.

FIG. 2 shows how the elongated shape of one of the walls is utilized to obtain a precise guidance of the coupling slide 33. The latter has a circular channel 68 formed during extrusion whose ends are equipped with circular studs 57, 58 pivoting in the ends 55, 56 of two oscillating levers 52, 53 arranged on either side of the front surfaces of walls 8, 9.

These levers are themselves pivoted by their own circular portions 74, 75 in openings formed by a cylindrical channel 66 formed during the extrusion of the shaped section forming wall 9. This cylindrical channel could optionally be provided on the wall but this would lead to unnecessary and costly complications. A shaft 54 of polygonal, e.g. square cross-section penetrates the circular portions 74, 75 to ensure a simultaneous movement and absolute parallelism of the two guidance levers 52, 53. The axial displacements of the lever and the coupling shaft 54 can be limited by any per se known means or, for example, by a wall 76 of a lateral flange 72 which can also fulfil other functions.

The elastic restoring of the coupling slide 33 is brought about by means of two independent levers 64, 65 which pivot on the ends 70, 71 of a fixed common cylindrical shaft 59 placed in a channel 67 comparable to channel 66 described hereinbefore. Channel 66, in the embodiment shown, is made in wall 8 in such a way that the same shaped section can be used to produce the two walls.

The central area of shaft 59 has a cylindrical ring 69 integral therewith. In the zone between the two levers 61, 62 and ring 69 are provied two helical springs 100, 101 whereby one of the ends thereof is fixed to the central ring and the other thereof is connected to the nearest lever.

When the levers oscillate, the springs supply a restoring torque due to their method of operating by flexure. The ends 70, 71 of shaft 59 are maintained in the two lateral flanges 72, 73 to prevent the rotation thereof.

As the number of contact units arranged on the apparatus as well as the energy of the electro-magnet operating them are variable, it is desirable to give the restoring springs a previously perfectly adapted tension..

Such a regulation is obtained due to the fact that one of the ends 71 has a grooved portion 77 which penetrates an also grooved opening in flange 73 and whereby through an axial displacement of shaft 59 it is possible to disassemble the portion and the grooved opening to give them a different relative angular position, e.g. by means of a screwdriver or similar tool.

Here again, the lateral flanges 72, 73 can be used to axially maintain in place levers 61, 62 whose ends 64, 65 have forks 78, 79 which are engaged on the studs 57, 58 described hereinbefore.

If one of the restoring springs fails, the function of rendering inoperative is ensured by the other spring.

The movements of these levers can be utilized to operate by means of a bellcrank lever 74 shown in FIG. 1 a not shown auxiliary contact or ensure an external locking by means of a main drive pinion 99 shown in FIG. 2 for connection with an adjacent contactor.

In a varient which does not go beyond the scope of the invention, it is possible to combine the restoring and guidance functions within one and the same channel also made in the material of a shaped wall as hereinbefore.

Such a varient is shown in FIG. 3 where the same reference numerals indicate the same members as hitherto.

However, it can be seen that the regulation of the spring rigidity is performed in a different manner whilst remaining accessible, i.e. without it being necessary to dismantle the apparatus by means of the central ring 69 which receives the end of springs such as 101 and whose angular position in the circular channel 67 where it pivots is fixed by means of the screw 81 which locks it through an oblong opening 80 in the wall of the channel.

Finally, in another variant illustrated in FIGS. 4 and 5, the guidance levers and elastic restoring device are combined.

However, the combination has been extended in order to merge the two systems of levers substituting them by a single lever 84 constituted by a portion of an extruded shaped section of length close to that of walls 8, 9 whereof one extreme cylindrical edge 82 is pivoted via a self-lubricating sleeve 85 in a cylindrical channel 83 whereof one portion of the inner surface has been removed so that a longitudinal opening 92 is offered towards the inside of the apparatus.

An analogous pivoting system is arranged on the other extreme edge 87 of guidance lever 84 to ensure the guidance of the coupling slide 185 which in turn has a cylindrical channel portion 86.

The first edge 82 pivoted in wall 8 has in turn a longitudinal cylindrical channel 88 obtained by extrusion wherein is arranged the elastic restoring system 89 which can be a helical spring or a torsion bar group and which is visible in FIG. 5.

One of the ends 89 of the elastic system is anchored in a recess 189 of lever 84 whilst the other end can be fixed in regulatable manner by member 91 and screw 95 on one flange 187 shown in FIG. 5. The assembly of such a system is extremely rapid and has a rigidity relative to buckling which guarantees the perfect simultaneity of closing of the various contacts as well as extremely limited wear of the surfaces moving relative to one another.

We claim:

1. In an electro-magnetic contactor having a casing which includes two generally planar sections respectively constituting first and second parallel walls each having at its upper portion a system of slides, a base connecting said walls at their lower portion, one or more contact-units received in said slide systems and including an actuating member having an inner portion slidingly mounted in said contact-unit and an outer portion adapted to be associated with a common coupling section which is placed between said parallel walls and is brought into movement by an electromagnet, the improvement that:

at least the first wall includes a first longitudinal cylindrical recess obtained during extrusion of said wall at least one restoring system, acting upon said coupling section and an associated resilient member, is rotatingly mounted in said recess at least one guiding system, swivelling mounted on a wall along an axis parallel to that of said recess, is provided at its free end with a articulation whose axis is determined by a centering recess obtained during extrusion of said coupling section.

2. A contactor, according to claim 1, wherein said at least one guiding system is constituted by two guiding levers angularly fixed at both ends of a first common shaft located in a second longitudinal recess obtained during extrusion of the second wall, said articulation comprising two cylindrical studs each fastened in the centering recess at a respective transverse end of the coupling section, and the restoring system comprises two restoring levers pivoted at a respective one of the ends of a second common shaft extending through the first recess and angularly connected with the casing, the free end of said levers being subjected to the action of torsion springs disposed concentrically with and connected to said second shaft.

3. A contactor, according to claim 2, wherein the second recess is a cylindrical channel swivellingly receiving the guiding levers, and the second shaft is supported at each extremity by a respective one of two lateral flanges each secured to a lateral surface of the parallel walls.

4. A contactor, according to claim 2, wherein at least one extremity of the second shaft has, on its periphery, projections adjustably cooperating with recesses in the lateral flanges.

5. A contactor, according to claim 1, wherein the restoring system and the guiding system are both concentrically pivoted in the first recess.

6. A contactor, according to claim 1, wherein the guiding and the restoring systems are constituted by a single oscillating lever having a first cylindrical end pivoted in a single cylindrical channel of a wall, a restoring spring being disposed in a longitudinal recess of said first end and arranged to exert a resilient force upon said lever, and the second end of said lever is articulated in the centering recess.

* * * * *